US005212355A

United States Patent [19]

Edwards et al.

[11] Patent Number: 5,212,355

[45] Date of Patent: May 18, 1993

[54] SOUND ABSORPTIVE FILE CABINET DOOR

[75] Inventors: John Edwards, Nobleton; Douglas Boileau, Bradford, both of Canada

[73] Assignee: Hollanding Inc., Newmarket, Canada

[21] Appl. No.: 779,332

[22] Filed: Oct. 18, 1991

[51] Int. Cl.[5] ..... E04B 1/82

[52] U.S. Cl. ..... 181/290; 181/294; 181/295; 312/409

[58] Field of Search ..... 181/30, 284, 286, 287, 181/288, 290, 291, 292, 293, 294, 295; 312/409

[56] References Cited

U.S. PATENT DOCUMENTS

| | | | |
|---|---|---|---|
| 2,132,642 | 10/1938 | Parsons | 181/290 |
| 2,160,638 | 5/1939 | Bedell et al. | 181/30 |
| 2,363,068 | 11/1944 | Leadbetter | 181/292 |
| 2,397,609 | 4/1946 | Leadbetter | 181/290 |
| 2,488,555 | 11/1949 | Pare | 181/292 |
| 2,528,049 | 10/1950 | Gonda | 181/292 |
| 2,897,908 | 8/1959 | Barshefsky | 181/292 |
| 3,021,916 | 2/1962 | Kemp | 181/292 |
| 3,822,762 | 7/1974 | Crispin et al. | 181/292 |
| 4,548,292 | 10/1985 | Noxon | 181/295 |

*Primary Examiner*—Michael L. Gellner
*Assistant Examiner*—Khanh Dang
*Attorney, Agent, or Firm*—Riches, McKenzie & Herbert

[57] ABSTRACT

A file cabinet is disclosed which has a door with high sound absorption properties. The door has metal front and rear panels and an intermediate layer of sound absorbing material sandwiched therebetween. An array of openings are cut through both the front and rear panel. Sound impinging on the front panel enters the cabinet via the door and is attenuated in the door and cabinet. Preferably, paper files are stored within the file cabinet with their peripheral edge surfaces disposed towards the rear panel to assist in attenuating sound within the cabinet.

19 Claims, 3 Drawing Sheets

SOUND ABSORPTIVE FILE CABINET DOOR

SCOPE OF THE INVENTION

This invention relates generally to a filing cabinet and, more particularly, to a file cabinet having a door with high sound absorption properties by reason of openings cut through the front and rear panels of the door to facilitate sound impinging thereon passing therethrough, whereby sound is dampened or absorbed by sound absorptive material placed between the front and rear panels as well as, preferably, paper and cardboard sheet material stored within the filing cabinet itself.

BACKGROUND OF THE INVENTION

Presently, metal file cabinets typically have doors manufactured with a solid, planar metal front panel. A file cabinet with such a door has the disadvantage in that the front panel of the file cabinet door acts to reflect sound waves impinging thereon. The reflection of sound waves in the work place, for example, from employee conversations, telephones, typewriters and other office equipment, by such known metal file cabinets has the disadvantage of tending to increase the perceived level of noise in an office environment, increasing employee discomfort and distraction. It is desirable to reduce noise within an office environment to create a relaxing, pleasant environment in which to work.

SUMMARY OF THE INVENTION

Accordingly, it is an object of the present invention to at least partially overcome these disadvantages by providing a file cabinet which dampens and absorbs a portion of the sound impinging thereon, to assist in reducing the level of noise in an office environment.

The present invention provides a file cabinet of otherwise known construction having a door manufactured with a metal front panel and a layer of sound absorptive material placed rearward thereof. Although not necessary, preferably, a rear panel is also provided rearward of the layer of sound absorptive material. The door preferably permits a substantial proportion of sound impinging on the front panel to pass through the door from the front panel to the rear of the door and into the storage compartment for attenuation therein.

The front panel of the door has openings cut therethrough so that sound may readily pass through the front panel and into the sound absorptive intermediate layer. A layer of fabric may be provided covering the outwardly facing surface of the front panel.

The intermediate layer of sound absorptive material may be, for example, a rigid unitary panel of paper board acoustical tile or acoustical foam, a sheet of foam rubber, an injectable liquid or foam which solidifies after placement, loose or compressed cotton fibers, or any other material suitable to deaden and absorb sound waves. Preferably, the sound absorbing material may permit a substantial proportion of sound impinging on it to pass therethrough.

The rear panel, when provided, has openings cut therethrough to permit sound passing throughout the layer of sound absorbing material to pass through the rear panel into the storage compartment of the filing cabinet.

It has been found that sound passing through the door into the storage compartment is advantageously dampened and absorbed therein when sheet material such as paper files and cardboard file folders are stored in the compartment and, most preferably, when the paper files and file folders are arranged with their peripheral edge surfaces disposed directed towards the rear panel, for example, with the sheet material arranged to extend rearwardly, perpendicular to the rear of the door.

To this end, in one of its aspects, this invention provides a filing cabinet having a storage compartment and door means movable between open and closed positions to provide access to the storage compartment, the improvement wherein said door means comprises a front panel and a layer of sound absorptive material disposed rearward of said front panel, a plurality of first openings through said front panel permitting a substantial proportion of sound impinging on said front panel to pass therethrough and into said layer of sound absorptive material.

BRIEF DESCRIPTION OF THE DRAWINGS

Further objects and advantages will become apparent from the following description taken together with the accompanying drawings in which.

DETAILED DESCRIPTION OF THE DRAWINGS

Figure 1:
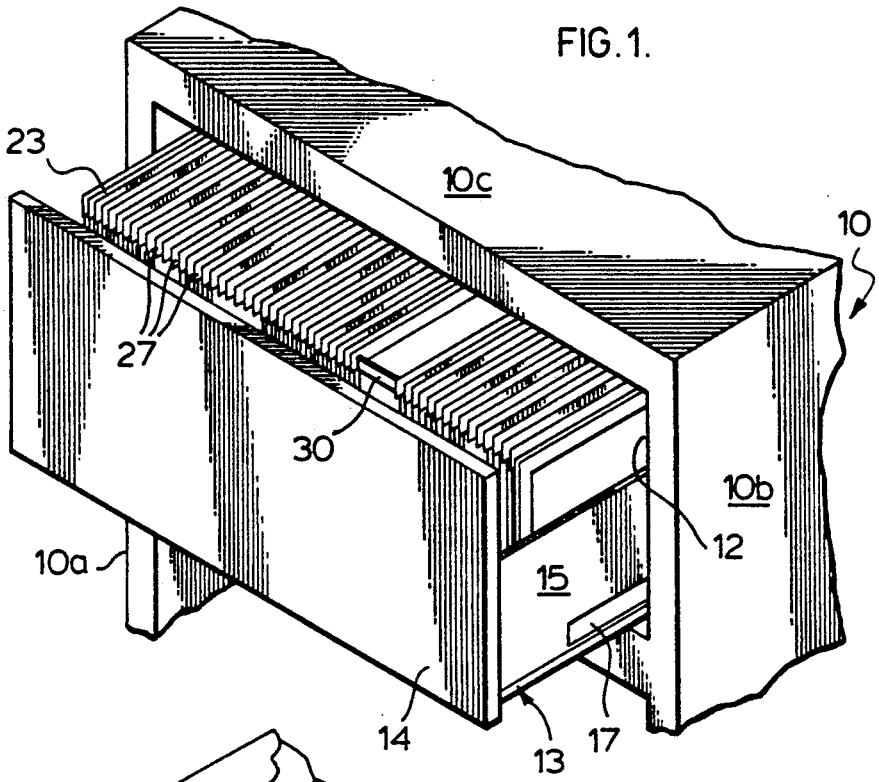
FIG. 1 is a partial perspective view of a file cabinet in accordance with a first embodiment of the present invention.

In the disclosure the same reference numerals refer to equivalent elements.

Reference is now made to FIG. 1 which shows a metal filing cabinet 10 in accordance with a first embodiment with a slidable drawer 13 having as its front a door 14. Cabinet 10 has side walls 10*a*, 10*b*, a top wall 10*c* and a rear wall defining an internal cavity 12 with a large forwardly directed access opening. The drawer 13 is horizontally slidable mounted by known slide beams 17 to each side wall 10*a*, 10*b* for sliding forwardly and rearwardly into and out of the cavity 12. The drawer 13 includes a file cabinet door 14 which, with sides 15 and the back of the drawer, define a storage compartment.

Figure 2:
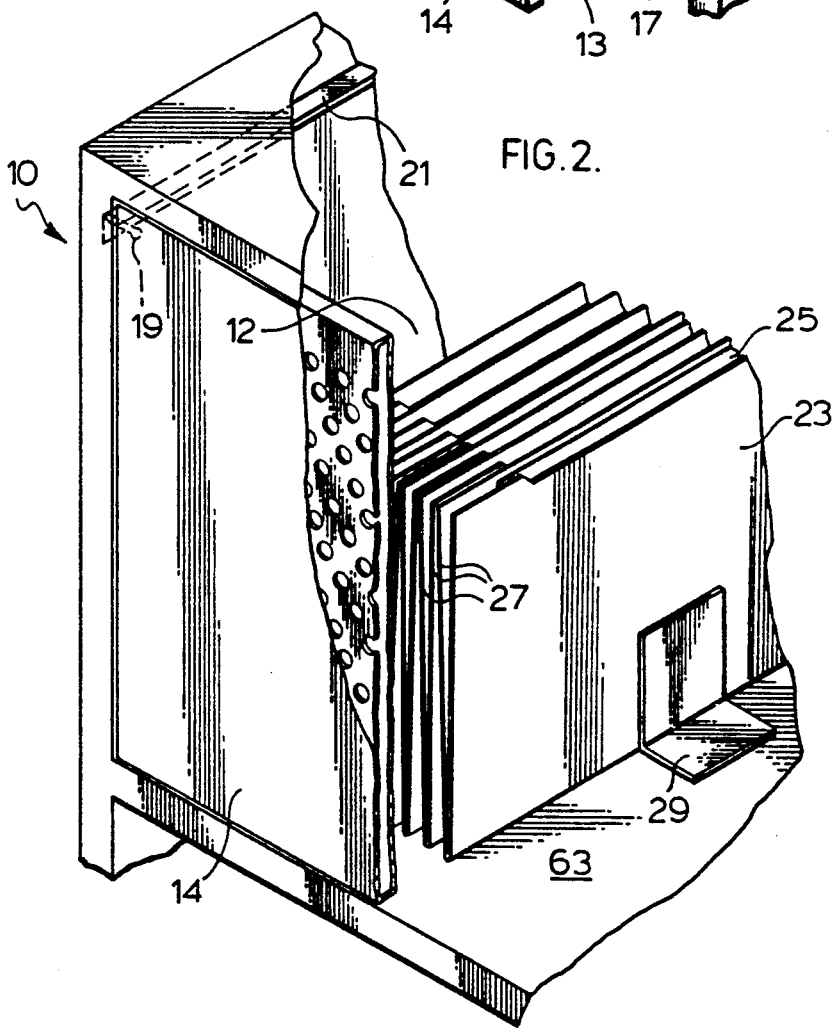
FIG. 2 is a partially cut away, partial perspective view of a file cabinet in accordance with a second embodiment of the present invention.

FIG. 2 shows a metal filing cabinet 10 in which, in a known manner, its door 14 is a lift up door which is pivotally connected at its upper end to slide members 19 horizontally slidable in a track 21 in the cabinet 10, such that the door 14 after being pivoted about members 19 from the vertical position shown in FIG. 2 to a horizontal position may, when horizontal, be pushed into the cabinet 10 for storage out of the way. FIG. 2 shows a fixed shelf 63 in the cavity 12 such that the storage compartment for the files 23 is formed by the shelf 63. As is known one or more horizontally slidable drawers could be provided in replacement of shelf 63.

Figure 3:
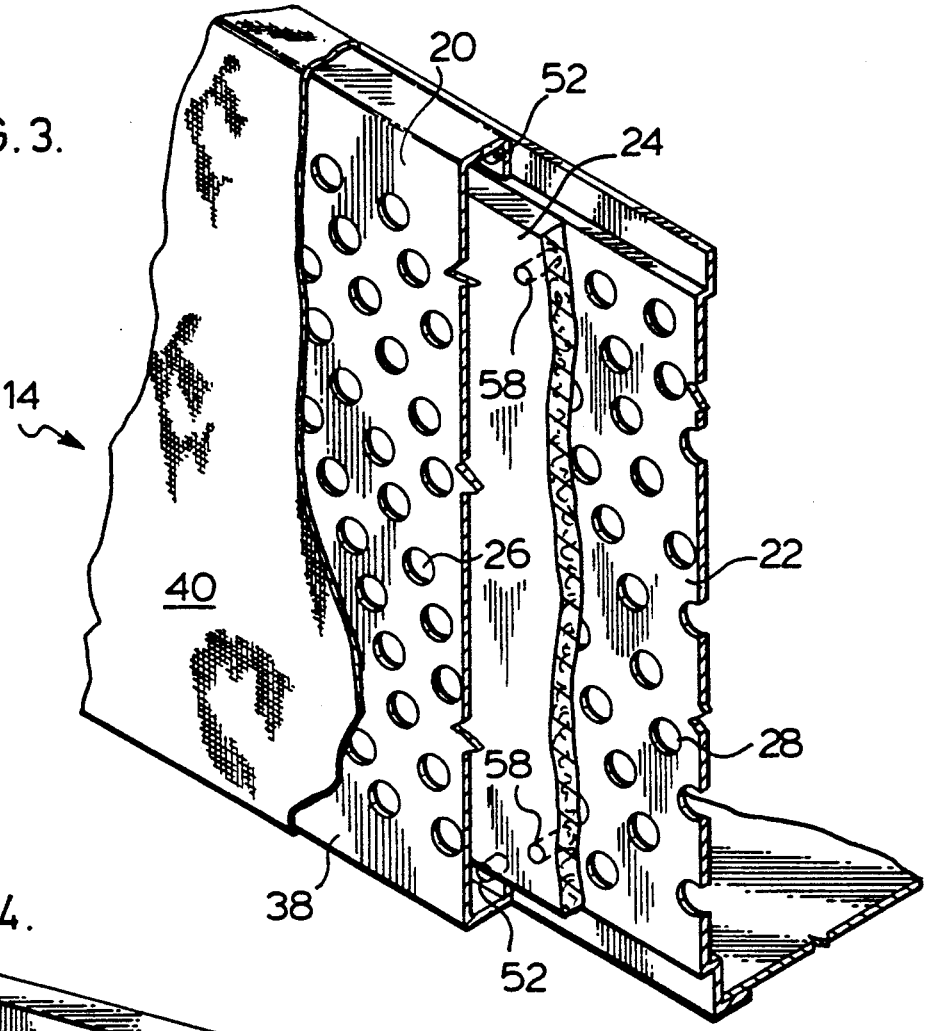
FIG. 3 is an enlarged partially cut away view of a file cabinet door of FIG. 1.

FIG. 3 shows a construction for the file cabinet door 14 used in both file cabinets of FIGS. 1 and 2. Door 14 comprises a front panel 20 and rear panel 22, both of sheet metal construction, and a unitary intermediate panel of sound absorptive acoustical foam 24. The panels are secured together by rivets 52 and 58 with the panel of acoustical foam 24 between the front panel 20 and rear panel 22.

Importantly, both front panel 20 and rear panel 22 have openings 26 and 28, respectively cut therethrough such that sound may pass through each panel via the openings. The panel of acoustical foam 24 located between the front and rear panels 20, 22 serves to assist in absorbing and dampening sound waves passing into the door 14 through either panel.

In addition to the construction and configuration of the door 14, the present invention also proposes that files 23 including sheet material be disposed within the file cabinet 10 in an advantageous manner to attenuate noise. As seen in both FIGS. 1 and 2, files 23 containing paper sheets 25 with peripheral edges 27 are disposed within the compartment of the file cabinet 10 such that peripheral edges 27 surface of the files 23 and paper sheets 25 are disposed, proximate the rear panel 22 and directed toward the rear panel 22 when the door 14 is in the closed position. The files 23 and sheets 25 are shown disposed generally vertically and extending perpendicularly rearward from the rear panel 22. The files 23 and sheets 25 are disposed such that sound passing through the rear panel 22 impinges on the edges 27 of the files 23 and sheets 25 of paper. This can substantially increase sound absorption. While any articles stored in the compartments can assist in sound reduction, disposing the files 23 and/or sheets 25 with their edges 27 directed where the sound passes through the rear panel 22 will increase sound reduction as compared to having sound, for example, impinge on a flat, broad planar side surface of a file disposed in a vertical plane parallel to that of the rear panel 22.

In the cabinet of FIG. 2, a compressor 29 is provided to orient files in the desired manner. No such system is shown in FIG. 1 although advantageous known systems such as bars 30 for lateral hanging files 23 and dividers can be provided.

Sound reduction is believed to be accomplished in the door 14 in the following manner. A percentage of any sound impinging on the outside of the door 14 when it is closed will firstly pass through the openings 26 in the front panel 20 and, hence, into the acoustical foam 24. Acoustical foam 24 will serve to absorb some of this passed sound. Sound reflected from foam 24 will, to some extent, be re-reflected from the inside surface of the front panel 20 back towards the foam 24. Sound passing through the foam 24 will either be reflected back from the inside surface of the rear panel 22 or pass through the rear panel 22 via its openings 28 into cavity 12. Sound passing through rear panel 22 into cavity 12 can be absorbed by impinging upon the paper sheets 25 and files 23 stored in the compartment. Thus, the cabinet door 14 provides a surface whereby the reflection of sound waves is reduced by reason of sound waves being dampened and absorbed by passing through the front panel 20 into a sound absorptive panel of acoustical foam 24, and further by passing through a rear panel 22 into files 23 contained in the file cabinet cavity 12.

Figure 4:
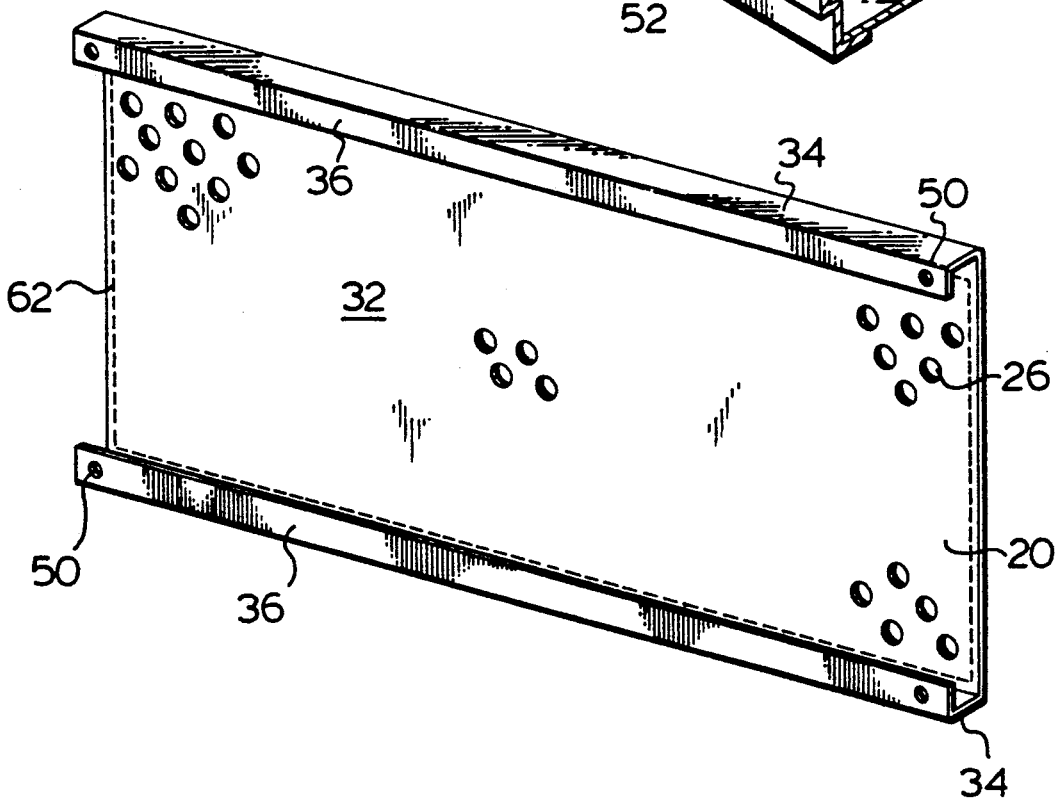
FIG. 4 is a perspective rear view of a front panel of the door of FIG. 1.
Figure 5:
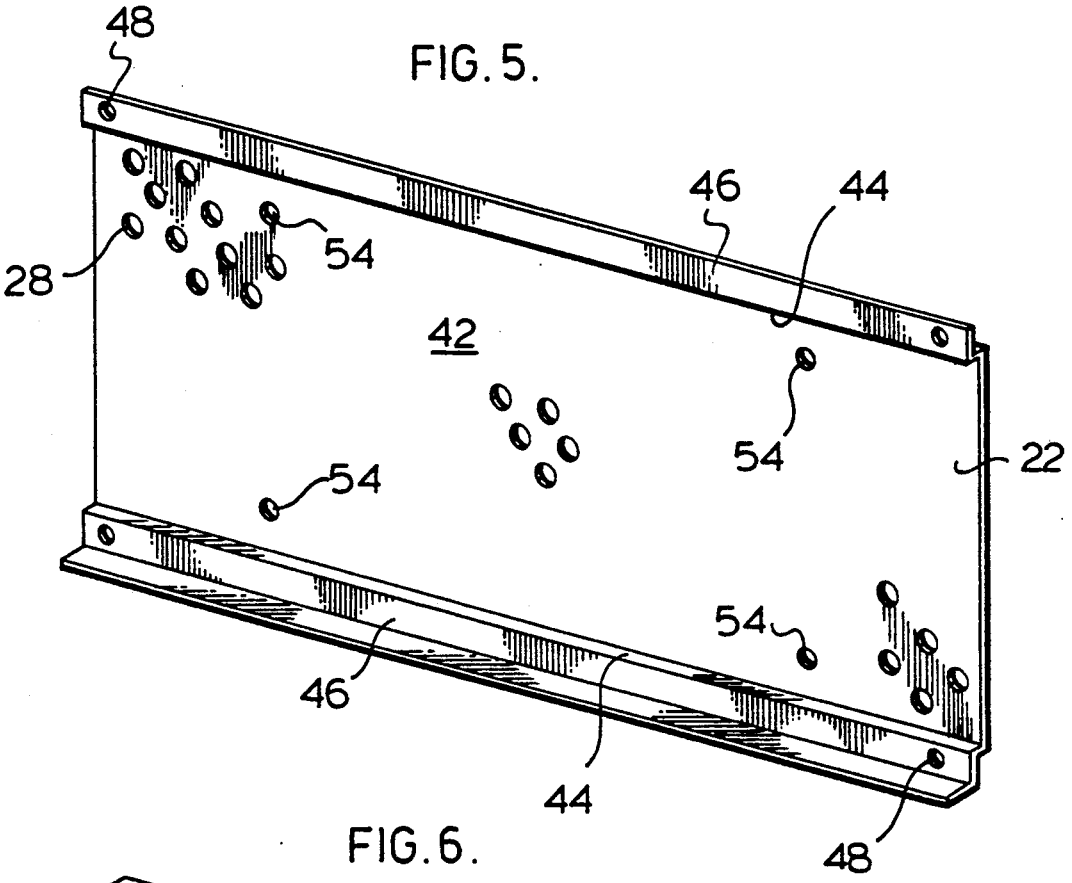
FIG. 5 is a perspective front view of a rear panel of the door of FIG. 1.
Figure 6:
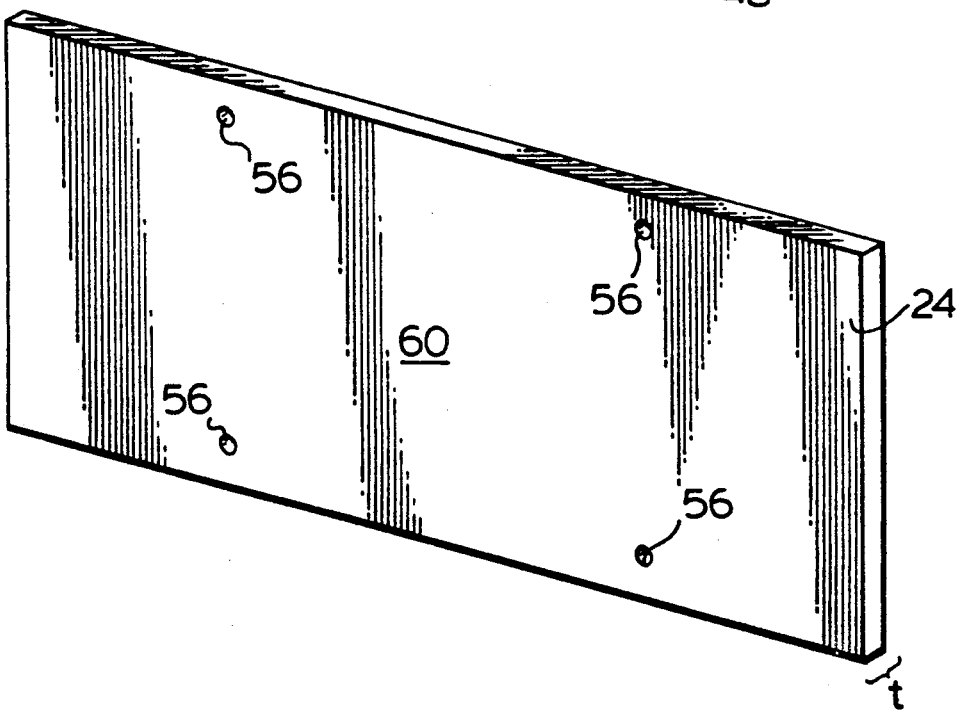
FIG. 6 is a perspective front view of a rigid panel of acoustical foam of FIG. 1 ready for assembly.

A preferred configuration for each of front panel 20, rear panel 22 and the rigid panel of acoustical foam 24 is shown in FIGS. 4, 5, and 6, respectively.

As seen in FIGS. 3 and 4, front panel 20 comprises a thin planar sheet of metal bent so as to provide at either end of a major flat central plane 32 an end surface 34 with an associated in turned flange 36. The front panel openings 26 in the preferred embodiment are provided as a series of parallel rows of equally spaced circular apertures through the major plane 32. To simplify illustration, FIG. 4 shows only some of the openings 26 which are, as shown in FIG. 3, to extend as an array over the whole surface of major plane 32. The circular apertures of each row are shown having offset centers from the circular apertures of adjacent rows forming the openings 26 into an offset grid-like network. Of course, the apertures need not be circular. As seen best in FIG. 3, the outer facing surface 38 of the front panel 20 is covered by a layer of fabric 40, which provides a more aesthetically pleasing file cabinet 10. Fabric 40 may be secured as by adhesive.

FIG. 5 shows the rear panel 22 as a thin planar sheet of metal bent to provide at either end of a major flat central plane 42, step flanges comprising an end surface 44 and an out-turned flange 46. The rear panel openings 28 are provided as a series of rows of equally spaced circular apertures through the major plane 42. The circular apertures of each row having offset centers from the circular apertures of adjacent rows forming the openings 28 into an offset grid-like network. Preferably, openings 28 are complementary to and aligned with the openings 26. As in FIG. 4 and in FIG. 5, only an illustrative number of openings 28 are shown rather than the complete array which would cover the whole surface of central plane 42. Holes 48 in flange 46 align with holes 50 of front panel 20 and permit the front panel 20 and rear panel 22 to become coupled together by rivets 52. While holes 54 in major plane 42 are provided for coupling of the acoustical foam panel 24, the foam panel may, more preferably, be secured by adhesive alone. In applying adhesive, the adhesive is to be applied to the panel, for example, panel 22 to which the foam is to be secured such that adhesive does not form a layer over the panel where the holes exist in the panel as the adhesive may affect sound transmittal. The same is applicable in bonding fabric 40 to front panel 28.

FIG. 6 shows the acoustical foam panel 24 to be a generally rectangular panel, similar in configuration to the major plane 32 of front panel 20. The foam panel 24 has a thickness t, to provide more effective sound absorption. Holes 56 may be provided in the panel 24 align with holes 54 in rear panel 22 to permit the acoustical foam and rear panels to be coupled together by rivets 58.

As is to be appreciated, the door 14 is assembled with the acoustical foam panel 24 intermediate the front panel 20 and rear panel 22 such that the major plane 60 of the acoustical foam panel 24 is located rearwardly from the major plane 32 of the front panel 20 and the major plane 42 of the rear panel 22 is located rearwardly from the major plane 60 of the acoustical foam panel 24.

FIG. 4 shows as a dotted line on the front panel the perimeter 62 of a major planar portion behind which there is provided the acoustical foam panel 24. A corresponding major planar portion is found on the rear panel. Preferably, this major planar portion represents between 90% and 100% of the area of the front panel 20. Preferably, each of the openings 26 and 28 represent a percentage of the area of this major portion of not less that about 5%, more preferably in the range of 5% to 50% of this area.

In the preferred embodiment shown in FIG. 3, the front panel openings 26 and rear panel openings 28 are shown to be circular apertures forming an offset grid-like network. Many other shapes of apertures and/or configurations are also possible. The front panel openings 26 may correspond to and be aligned with the rear panel openings 28, although this is not necessary.

While the drawings show a preferred embodiment of the invention having an intermediate layer of sound absorbing material comprising a rigid panel of acoustical foam 24, it is to be appreciated that the sound absorbing material is not so restricted and other sound absorbing materials may equally be used. In addition, other methods and devices required to insert and affix the layer of sound absorbing material between the front and rear panels may be substituted and will be apparent to persons skilled in this art.

The foam panel 24 may be manufactured into a rigid unitary panel by extruding into a mold form so as to have the shape and appearance as shown in FIG. 6. Providing a unitary panel of sound absorptive material is advantageous in that a sound absorptive material so formed is less likely to settle and compact after insertion into the door 14 structure, thereby maintaining its position behind the openings of the front panel. In addition, a unitary panel construction reduces the likelihood of loss of sound absorptive material through the openings 26,28.

The embodiment of FIG. 3 shows a file cabinet door having an outer surface 38 covered by fabric. This fabric covering is not necessary. Caution needs to be exercised in selecting the fabric covering and the method by which it is secured as some coverings have been found to decrease sound attenuation. Where no fabric covering is provided, it is advantageous to have the acoustical foam panel 24 spaced rearwardly from the front panel 20 so as to enhance the appearance of the filing cabinet 10, although it is not necessary.

A prototype filing cabinet was constructed substantially as shown in FIGS. 1 and 3 to 6 with the exception that the outer facing surface of the front panel was not covered with cloth 40. The filing cabinet measured 36 inches in width, 62.75 inches in height and 18.5 inches in depth. The filing cabinet had five drawers, each having a front panel major plane with dimensions of 34.5 inches in width by 11.75 inches in height. The major plane of both the front and rear panels of each of the five drawers was perforated. The perforations were 0.25 inch diameter circular holes on 0.75 inch offset centers forming an offset grid-like network of openings. The number of holes formed in each of the front and rear panels of the prototype file cabinet represented approximately 6.7% of the total surface area of each respective major plane. A panel of acoustical foam was inserted between the front and rear panels. The panel comprised a ½ inch thick polyester urethane having an open cell structure and a density of 1.8 to 2.0 lb./cu. ft as commercially available under the trade name FOAMFLEX 1820 from Jacobs & Thompson Inc. of Weston, Ontario, Canada. The cabinet was filled with paper files with the files extending vertically perpendicularly away from the door with their edges directed to the rear of the door.

Tests were conducted in accordance with the American Society for testing Materials designation ASTM C423-89, "Standard Test Method for Sound Absorption and Sound Absorption Coefficients by the Reverberation Room Method", to determine the sound absorption coefficient of the filing cabinets. Sound absorption and noise reduction coefficients shown in Table 1 were calculated employing the front absorptive area of the files, 15.69 $ft^2$, by analyzing the decay rate of sound in the reverberation room and utilizing the difference of the decay with and without the filing cabinet in the room. Each prototype filing cabinet was placed standing against the wall of a reverberation room filled to a normal capacity with paper files arranged laterally in a side to side fashion.

The sound absorption coefficient is defined as the fraction of the randomly incident sound power absorbed by the material. The noise reduction coefficient (NRC), is the arithmetic average of sound absorption coefficients at 250, 500, 1000, and 2000 Hz.

TABLE 1

| | Absorption Coefficients - Sabins/ft.$^2$ One-Third Octave Band Center Frequency Hz | | | | | | |
|---|---|---|---|---|---|---|---|
| | 125 | 250 | 500 | 1000 | 2000 | 4000 | NRC |
| File Cabinet No. 1 | 2.08 | 0.99 | 1.00 | 0.88 | 0.99 | 0.52 | 0.95 |

While the invention has been described with reference to the preferred embodiments, it is not so limited. Many variations and modifications will now occur to persons skilled in the art. For a definition of the invention, reference is made to the appended claims.

The embodiments of the invention in which an exclusive property or privilege is claimed are defined as follows:

1. A filing cabinet having a storage compartment and door means movable between open and closed positions to provide access to the storage compartment, and a plurality of paper sheet means removably placed in the storage compartment, wherein said door means comprises;

a front panel;

a layer of sound absorptive material disposed rearward of said front panel;

a rear; and a plurality of first openings through said front panel;

the first openings permitting a substantial proportion of sound impinging on said front panel to pass therethrough and into said layer of sound absorptive material, the door means permitting a substantial proportion of sound impinging on the front panel to pass through said door and out the rear into the storage compartment, said plurality of paper sheet means having peripheral edges removably disposed in said compartment for storage with the peripheral edges proximate the rear of the door means and directed towards said rear when the door means is in the closed position, such that sound passing through said rear impinges on said peripheral edges.

2. A filing cabinet as claimed in claim 1 including retaining means disposed in the compartment for orientation of said paper sheet means with the peripheral edges rearward of and directed toward the rear of said door means when the door means is in a closed position, such that sound passing rearward through said rear will be directed toward said peripheral edges.

3. A filing cabinet as claimed in claim 1 wherein said door means further comprises:

a rear panel disposed rearward of said layer of absorptive material such that sound passing rearward through said layer of sound absorptive material impinges on the rear panel, a plurality of second openings through said rear panel permitting a substantial proportion of sound impinging on said rear panel to pass therethrough.

4. A filing cabinet as claimed in claim 3 including retaining means disposed in the compartment for orientation of said paper sheet means with the peripheral edges rearward of and directed toward the rear panel when the door means is in a closed position, such that sound passing rearward through the rear panel will be directed toward said peripheral edges.

5. A filing cabinet as claimed in claim 3 wherein said front panel comprises a thin sheet of metal and said rear panel comprises a thin sheet of metal.

6. A filing cabinet as claimed in claim 5 wherein said sound absorptive material comprises a rigid panel of acoustical foam.

7. A filing cabinet as claimed in claim 6 wherein an outer facing surface of said front panel is covered by fabric.

8. A filing cabinet as claimed in claim 4 wherein said front panel comprises a thin sheet of metal and said rear panel comprises a thin sheet of metal.

9. A filing cabinet as claimed in claim 8 wherein said sound absorptive material comprises a rigid panel of acoustical foam.

10. A filing cabinet as claimed in claim 9 wherein an outer facing surface of said front panel is covered by fabric.

11. A filing cabinet as claimed in claim 5 wherein said plurality of first openings comprise a first grid-like network of circular apertures, and said plurality of second openings comprise a second grid-like network of circular apertures.

12. A filing cabinet as claimed in claim 3 wherein said plurality of first openings comprise a first grid-like network of circular apertures, and said plurality of second openings comprise a second grid-like network of circular apertures.

13. A filing cabinet as claimed in claim 11 wherein said first network of circular apertures is aligned with said second network of circular apertures.

14. A filing cabinet as claimed in claim 3 wherein said door means is coupled to the filing cabinet for pivoting about a horizontal axis to move from the open to the closed position.

15. A filing cabinet as claimed in claim 3 including drawer means defining said compartment slidable horizontally, forwardly and rearwardly into and out of the filing cabinet, and said door means forming a front wall of said drawer means.

16. A filing cabinet as claimed in claim 3 wherein said front panel includes a central first major portion having a surface area substantially equal to a surface area of an outer facing surface the door means, and said rear panel includes a central second major portion having a surface area substantially equal to a surface area of an inner facing surface of the door means, said first openings comprise between four and fifteen percent of the surface area of said first major portion, and said second openings comprise between four and fifteen percent of the surface area of said second major portion.

17. A filing cabinet as claimed in claim 16 wherein said first major portion is substantially planar over said second planar portion.

18. A filing cabinet as claimed in claim 1 wherein said paper sheet means comprises planar paper sheets disposed in said compartment in a plane normal to the rear of the door means.

19. A filing cabinet as claimed in claim 3 wherein said paper sheet means comprises planar paper sheets disposed in said compartment in a plane normal to the rear of the door means.

* * * * *